US011084508B2

(12) United States Patent
Vande Sande et al.

(10) Patent No.: US 11,084,508 B2
(45) Date of Patent: Aug. 10, 2021

(54) LONGITUDINAL SLIDING GATE FOR HOPPER CAR

(71) Applicant: Trinity Industries, Inc., Dallas, TX (US)

(72) Inventors: Jerry W. Vande Sande, Dallas, TX (US); Aubra D. McKisic, Flower Mound, TX (US); Joseph T. Float, Manor, PA (US); Michael James Madden, Pittsburgh, PA (US); Joseph L. Gagliardino, Oakdale, PA (US)

(73) Assignee: Trinity Industries, Inc., Dallas, TX (US)

( * ) Notice: Subject to any disclaimer, the term of this patent is extended or adjusted under 35 U.S.C. 154(b) by 345 days.

(21) Appl. No.: 16/216,653

(22) Filed: Dec. 11, 2018

(65) Prior Publication Data

US 2019/0202481 A1 Jul. 4, 2019

Related U.S. Application Data

(60) Provisional application No. 62/599,338, filed on Dec. 15, 2017.

(51) Int. Cl.

| | |
|---|---|
| ***B61D 7/20*** | (2006.01) |
| ***B61D 7/06*** | (2006.01) |
| ***B61D 9/00*** | (2006.01) |
| ***B61D 7/26*** | (2006.01) |
| ***B61D 7/02*** | (2006.01) |
| *B61D 3/06* | (2006.01) |

(52) U.S. Cl.

CPC ..... *B61D 7/06* (2013.01); *B61D 7/02* (2013.01); *B61D 7/20* (2013.01); *B61D 7/26* (2013.01); *B61D 9/00* (2013.01); *B61D 3/06* (2013.01)

(58) Field of Classification Search

CPC ... B61D 7/06; B61D 7/02; B61D 7/10; B61D 7/16; B61D 7/20; B61D 7/26; B61D 7/28; B61D 7/22

See application file for complete search history.

(56) References Cited

U.S. PATENT DOCUMENTS

| | | | | | |
|---|---|---|---|---|---|
| 2,020,863 | A * | 11/1935 | Willoughby | ..... | B61D 7/16 105/282.2 |
| 2,020,880 | A * | 11/1935 | Dietrichson | ..... | B61D 7/16 105/282.2 |
| 6,073,562 | A * | 6/2000 | Cozine | ..... | B61D 7/20 105/247 |

(Continued)

*Primary Examiner* — S. Joseph Morano
*Assistant Examiner* — Cheng Lin
(74) *Attorney, Agent, or Firm* — Baker Botts, LLP

(57) ABSTRACT

According to some embodiments, a railcar comprises an underframe and at least one hopper. The hopper is configured to transport a lading material. A longitudinal sliding gate assembly is coupled to the hopper and comprises: a pair of side walls coupled to a pair of end walls forming a discharge opening; a pair of tracks, one coupled to each end wall; a sliding gate slidably coupled to the pair of tracks; and a threaded drive screw coupled to the sliding gate and to the pair of side walls. Rotation of the threaded drive screw in a first direction moves the sliding gate along the tracks to an open position that permits the lading material to discharge, and rotation of the threaded drive screw in an opposite direction moves the sliding gate along the tracks to a closed position that restricts the lading material from discharging.

16 Claims, 21 Drawing Sheets

(56) References Cited

U.S. PATENT DOCUMENTS

| | | | | |
|---|---|---|---|---|
| 6,571,718 | B2 * | 6/2003 | Lucas | B61D 7/20 105/282.3 |
| 6,899,038 | B2 * | 5/2005 | Fortuna | B61D 7/20 105/282.2 |
| 7,171,907 | B2 * | 2/2007 | Early | B61D 7/20 105/247 |
| 7,752,979 | B2 | 7/2010 | Early | |
| 7,806,057 | B2 * | 10/2010 | Early | B61D 7/20 105/253 |
| 7,814,642 | B1 | 10/2010 | Early | |
| 7,814,842 | B2 * | 10/2010 | Early | B61D 7/26 105/282.3 |
| 7,819,067 | B2 | 10/2010 | Early | |
| 8,534,204 | B2 * | 9/2013 | Blankenship | B61D 7/20 105/308.1 |
| 8,596,203 | B2 * | 12/2013 | Forbes | B61D 7/28 105/248 |
| 8,850,991 | B2 * | 10/2014 | Early | B61D 7/26 105/286 |
| 9,358,988 | B2 * | 6/2016 | Early | B61D 7/02 |
| 9,393,970 | B2 * | 7/2016 | Senn | B61D 7/26 |
| 10,315,668 | B2 * | 6/2019 | Early | B61D 7/02 |
| 2009/0235840 | A1 * | 9/2009 | Early | B61D 7/20 105/282.3 |

* cited by examiner

LONGITUDINAL SLIDING GATE FOR HOPPER CAR

RELATED APPLICATIONS

This application claims priority to U.S. Provisional Application Ser. No. 62/599,338 entitled "LONGITUDINAL SLIDING GATE FOR HOPPER CAR," filed Dec. 15, 2017, the entire content of which is incorporated herein by reference.

TECHNICAL FIELD

Particular embodiments relate generally to railcars, and more particularly to a hopper car with a sliding longitudinal gate.

BACKGROUND

Railway hopper cars transport and sometimes store bulk materials. Hopper cars generally include one or more hoppers which may hold cargo or lading during shipment. Hopper cars are frequently used to transport coal, sand, metal ores, aggregates, grain and any other type of lading which may be satisfactorily discharged through openings formed in one or more hoppers. Discharge openings are typically provided at or near the bottom of each hopper to rapidly discharge cargo. A variety of door assemblies or gate assemblies along with various operating mechanisms have been used to open and close discharge openings associated with railway hopper cars.

Transversely oriented discharge openings and gates are frequently coupled with a common linkage operated by an air cylinder. The air cylinder is typically mounted in the same orientation as the operating gate linkage which is often a longitudinal direction relative to the associated hopper.

Longitudinally oriented discharge openings and doors are often used in pairs that may be rotated or pivoted relative to the center sill or side sills of a hopper car. Longitudinally oriented discharge openings and doors may be coupled with a beam operated by an air cylinder. The air cylinder is typically mounted in the same orientation as the operating beam which is often a longitudinal direction relative to the associated hopper. The operating beam may be coupled to the discharge doors by door struts that push (or pull) the gates open or pull (or push) them closed as the air cylinder moves the operating beam back and forth.

Hopper cars may be classified as open or closed. Hopper cars may have relatively short sidewalls and end walls or relatively tall or high sidewalls and end walls. The sidewalls and end walls of many hopper cars are often formed from steel or aluminum sheets and reinforced with a plurality of vertical side stakes or support posts. Some hopper cars include interior frame structures or braces to provide additional support for the sidewalls.

SUMMARY

According to some embodiments, a railcar comprises an underframe and at least one hopper coupled to the underframe. The hopper is configured to transport a lading material. A longitudinal sliding gate assembly is coupled to the at least one hopper. The longitudinal sliding gate assembly comprises: a pair of side walls coupled to a pair of end walls forming a discharge opening; a pair of tracks, one coupled to each end wall; a sliding gate slidably coupled to the pair of tracks; and a threaded drive screw coupled to the sliding gate and to the pair of side walls. Rotation of the threaded drive screw in a first direction moves the sliding gate along the tracks to an open position that permits the lading material to discharge through the discharge opening, and rotation of the threaded drive screw in an opposite direction to the first direction moves the sliding gate along the tracks to a closed position that restricts the lading material from discharging through the discharge opening.

In particular embodiments, the sliding gate is oriented horizontally and operates in a transverse direction across the railcar.

In particular embodiments, longitudinal sliding gate assembly further comprises a first capstan coupled to one end of the threaded drive screw, the first capstan configured to receive a tool for applying rotation to the threaded drive screw. Some embodiments include a second capstan coupled to the other end of the threaded drive screw. The first and second capstans permit operation of the longitudinal sliding gate assembly from either side of the railcar.

In particular embodiments, the longitudinal sliding gate assembly further comprises a cross member coupled to the pair of side walls and positioned above the threaded drive screw to divert the lading material away from the threaded drive screw during discharge. The longitudinal sliding gate assembly may further comprise a cross member coupled to the pair of end walls. The cross member forms a first discharge opening between the cross member and one side wall and forms a second discharge opening between the cross member and the other side wall. The sliding gate may comprise a first longitudinal portion approximately the same size as the first discharge opening coupled to a second longitudinal portion approximately the same size as the second discharge opening. The first longitudinal portion may be separated from the second longitudinal portion by approximately the width of the cross member.

Particular embodiments include one or more longitudinal reinforcements coupled to the sliding gate. The one or more longitudinal reinforcements may comprise an opening for the threaded screw drive to pass through. Some embodiments include one or more longitudinal reinforcements coupled to the pair of end walls. The one or more longitudinal reinforcements may comprise an opening for the threaded screw drive to pass through.

As a result, particular embodiments of the present disclosure may provide numerous technical advantages. For example, particular embodiments combine the benefits of a longitudinal discharge gate (e.g., extends the entire length of the hopper bay) with the benefits of a sliding discharge gate (e.g., improved ground clearance compared to a hinged gate, simpler construction, etc.)

BRIEF DESCRIPTION OF THE DRAWINGS

A more complete and thorough understanding of the particular embodiments and advantages thereof may be acquired by referring to the following description taken in conjunction with the accompanying drawings, in which like reference numbers indicate like features, and wherein.

DETAILED DESCRIPTION

Railway hopper cars generally include two or more hoppers which may hold cargo or lading (e.g., bulk materials) during shipment. Hopper cars frequently transport coal, sand, metal ores, aggregates, grain, plastic pellets, and any other type of lading which may be satisfactorily discharged through openings formed in one or more hoppers. Discharge openings are typically provided at or near the bottom of each hopper to rapidly discharge cargo. A variety of door assemblies or gate assemblies along with various operating mechanisms have been used to open and close discharge openings associated with railway hopper cars. Particular embodiments include longitudinal discharge openings with a sliding gate.

Figure 1:
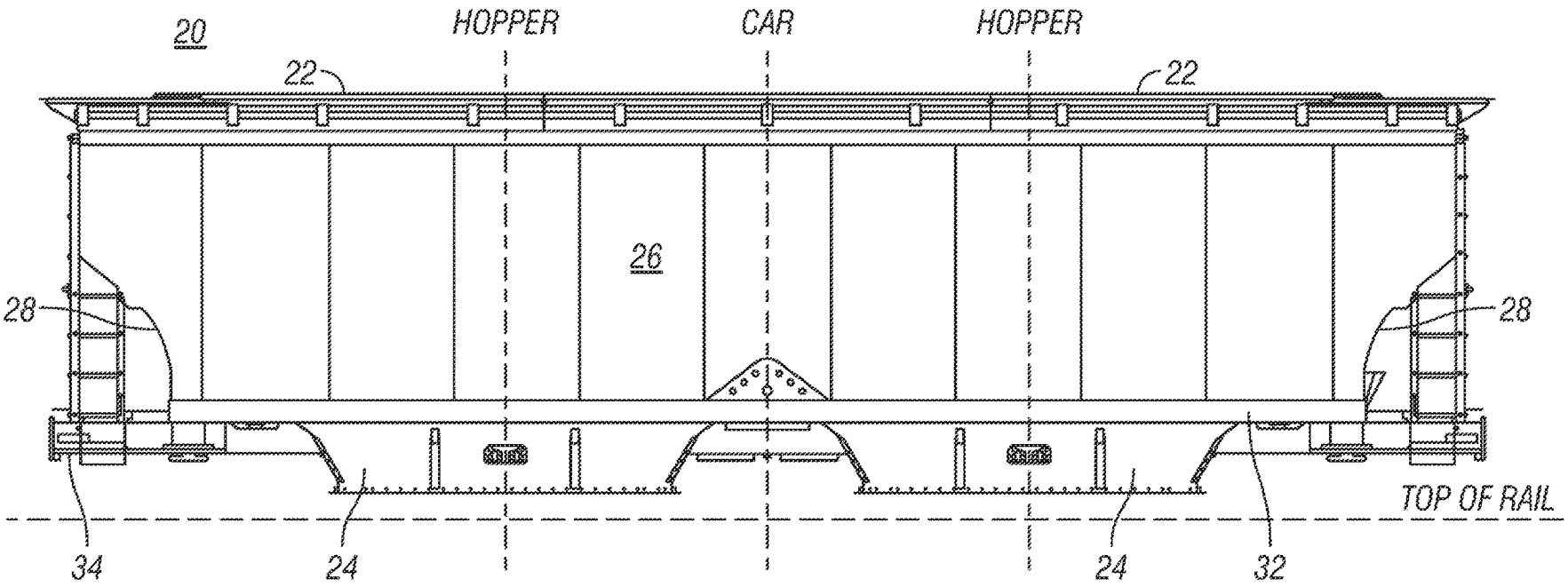
FIG. 1 is a schematic drawing in elevation showing a side view of an example hopper car.

FIG. 1 is a schematic drawing in elevation showing a side view of an example hopper car. Hopper car 20 may carry bulk materials such as coal and other types of lading.

Examples of such lading may include sand, metal ores, aggregate, grain, ballast, etc.

Hopper car 20 may be generally described as a covered hopper car. However, other hopper cars may include open hopper cars or any other cars suitable for carrying bulk lading.

Hopper car 20 includes hoppers 22 with bottom discharge assemblies 24. Discharge assemblies 24 may be opened and closed to control discharge of lading from hoppers 22. As illustrated, hopper car 20 includes two hoppers (or bays) 22. Discharge assemblies 24 may include transverse or longitudinal discharge gates. FIGS. 2-21 illustrate examples of a longitudinal discharge gate and particular components thereof.

Hopper 22 is configured to carry bulk materials and the interior walls of hopper 22 are generally sloped towards discharge assembly 24 to facilitate discharge of the lading.

Multiple hoppers 22 may be separated by interior bulkheads or partitions.

Hopper car 20 may include a pair of sidewall assemblies 26 and sloped end wall assemblies 28 mounted on a railway car underframe. The railway car underframe includes center sill 34 and a pair of shear plates 30. A pair of sill plates 32 provide support for sidewall assemblies 26.

Center sill 34 is a structural element for carrying the loads of the hopper car. Center sill 34 transfers the various longitudinal forces encountered during train operation from car to car. Shear plates 30 extend generally parallel with center sill 34 and are spaced laterally from opposite sides of center sill 34.

Figure 2:
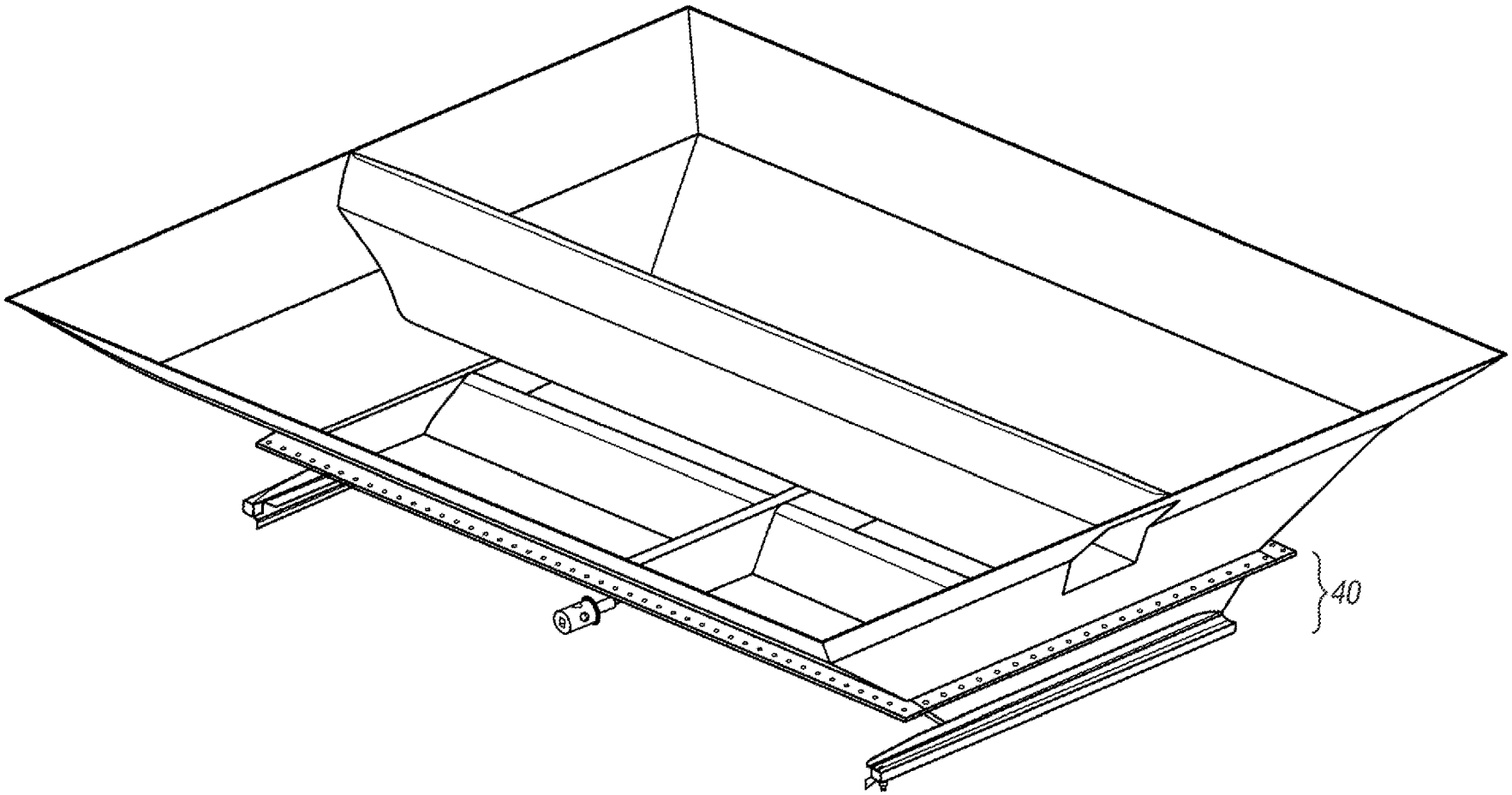
FIG. 2 is a perspective schematic illustrating an example of a longitudinal sliding gate assembly coupled to a portion of a hopper car.

FIG. 2 is a perspective schematic illustrating an example of a longitudinal sliding gate assembly coupled to a portion of a hopper car. Longitudinal sliding gate assembly 40 may be coupled to an opening in the bottom of a hopper car, such as hopper car 20 described with respect to FIG. 1. As one example, longitudinal sliding gate assembly 40 may be coupled to discharge assembly 24 or may comprise a portion of discharge assembly 24. In some embodiments, longitudinal sliding gate assembly 40 may be particularly suited for discharging grains from hopper car 20. In some embodiments, longitudinal sliding gate assembly 40 may discharge any suitable lading.

Although hopper car 20 in FIG. 1 is illustrated with two discharge assemblies 24, particular embodiments may include one, two, three, or any suitable number of discharge assemblies 24. Longitudinal sliding gate assembly 40 may be sized according to the size and number of discharge assemblies 24.

Figure 3:
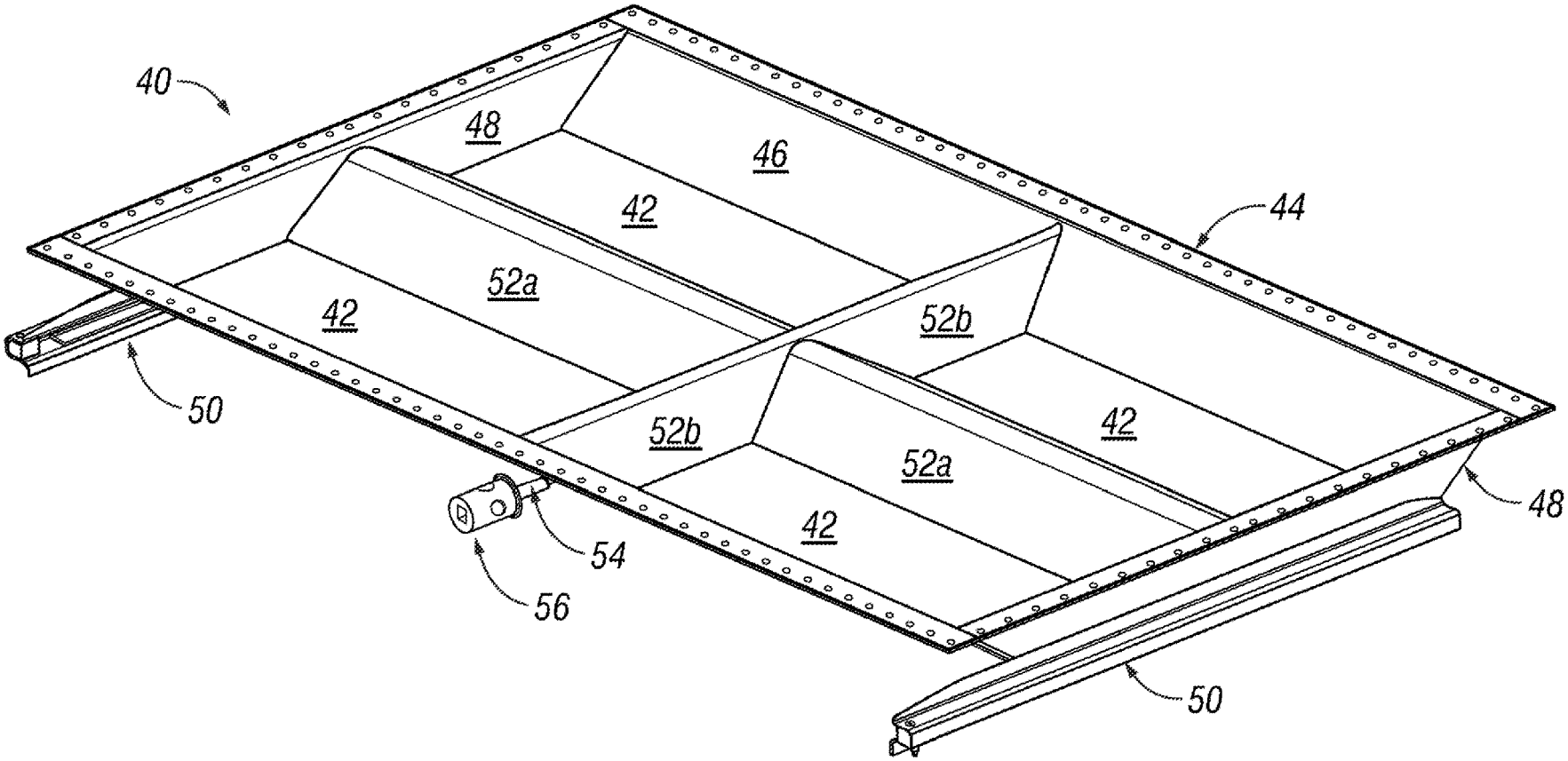
FIG. 3 is a perspective schematic illustrating a top view of an example longitudinal sliding gate assembly.

FIG. 3 is a perspective schematic illustrating a top view of an example longitudinal sliding gate assembly. Longitudinal sliding gate assembly 40 includes flange 44, side walls 46, end walls 48, tracks 50, threaded drive mechanism 54, and sliding gate 42.

Flange 44 is for mounting longitudinal sliding gate assembly 40 to a hopper car discharge opening. Flange 44 is coupled to side walls 46 and end walls 48. In particular embodiments, flange 44 may be coupled to the hopper car via welds, mechanical fasteners such as bolts, or any other suitable coupling method.

Side walls 46 and end walls 48 form a discharge opening for lading to discharge from the hopper bay. A track 50 is coupled to each end wall 48 opposite flange 44. Sliding gate 42 is movably coupled to tracks 50 and operable to slide on tracks 50 to open and close the discharge opening formed between side walls 46 and end walls 48. For reference, the portion of longitudinal sliding gate assembly 40 that includes flange 44 may be referred to as the top of longitudinal sliding gate assembly 40, and the portion that includes tracks 50 and sliding gate 42 may be referred to as the bottom of longitudinal sliding gate assembly 40.

Particular embodiments may include cross members 52 for structural support and/or to direct the lading upon discharge. For example, angled cross members may direct lading around particular operating components of longitudinal sliding gate assembly 40 (e.g., cross member 52*b* directs lading away from threaded drive mechanism 54).

In particular embodiments, threaded drive mechanism 54 is coupled to sliding gate 42 for opening and closing sliding gate 42. Threaded drive mechanism 54 may comprise a lead screw such as an acme screw, or any other suitable threaded rod or screw drive mechanism. Rotating threaded drive mechanism 54 in a first direction opens sliding gate 42 and rotating threaded drive mechanism 54 in a second direction closes sliding gate 42.

In some embodiments, an end of threaded drive mechanism 54 includes capstan 56, or any other suitable component for applying a rotational force to threaded drive mechanism 54. For example, an operator may couple a tool to capstan 56 to manually rotate threaded drive mechanism 54. In some embodiments, capstan 56 may be coupled to a pneumatically or electrically operated mechanism. Some embodiments include capstans 56 on each end of threaded drive mechanism 54, facilitating operation of sliding gate 42 from either side of the hopper car.

In the illustrated example, the combination of end walls 48, side walls 46, and center cross member 52*a* create two discharge openings, one on each side of the centerline of the hopper car. In some embodiments, another cross member, cross member 52*b*, shields the threaded drive mechanism during lading discharge. The combination of end walls 48, side walls 46, and center cross members 52*a* and 52*b* may create four discharge openings. The term discharge opening may refer to overall discharge opening formed by end walls 48 and side walls 46, or any other subdivided discharge opening created by various cross members.

Figure 4:
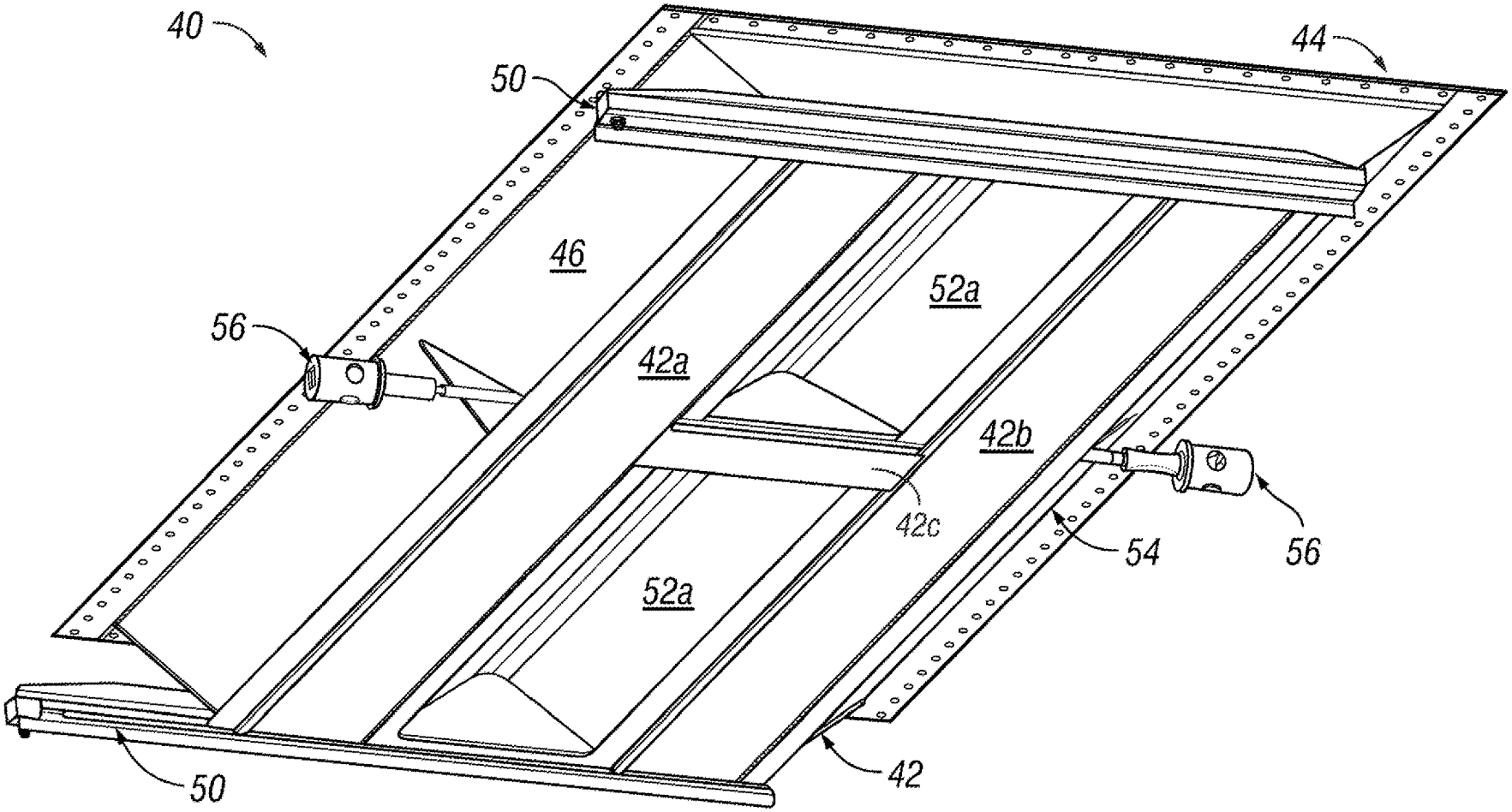
FIG. 4 is a perspective schematic illustrating a bottom view of an example longitudinal sliding gate assembly.

FIG. 4 is a perspective schematic illustrating a bottom view of an example longitudinal sliding gate assembly. In the illustrated embodiment, sliding gate 42 comprises two sections, 42*a* and 42*b*, coupled together with connector 42*c*. Sliding gate section 42*a* is operable to open or close the discharge opening formed between center cross member 52*a* and one side wall 46, and sliding gate section 42*b* is operable to open or close the discharge opening formed between center cross member 52*a* and the opposite side wall 46.

Sliding gate section 42*a* and 42*b* are coupled together so that both sections open or close at the same time upon rotation of threaded drive mechanism 54. Although sliding gate 42 may be described as two or more sections coupled together, the coupled sections form a single sliding gate 42. Sliding gate 42 is illustrated in the closed position in FIG. 4.

In the illustrated example, connector 42*c* is positioned under cross member 52*b* so that cross member 52*b* may direct the lading away from connector 42*c* during discharge. Other embodiments may include any number of connectors 42*c* positioned anywhere between sliding gate sections 42*a* and 42*b*, whether protected by a cross member or not.

Figure 5:
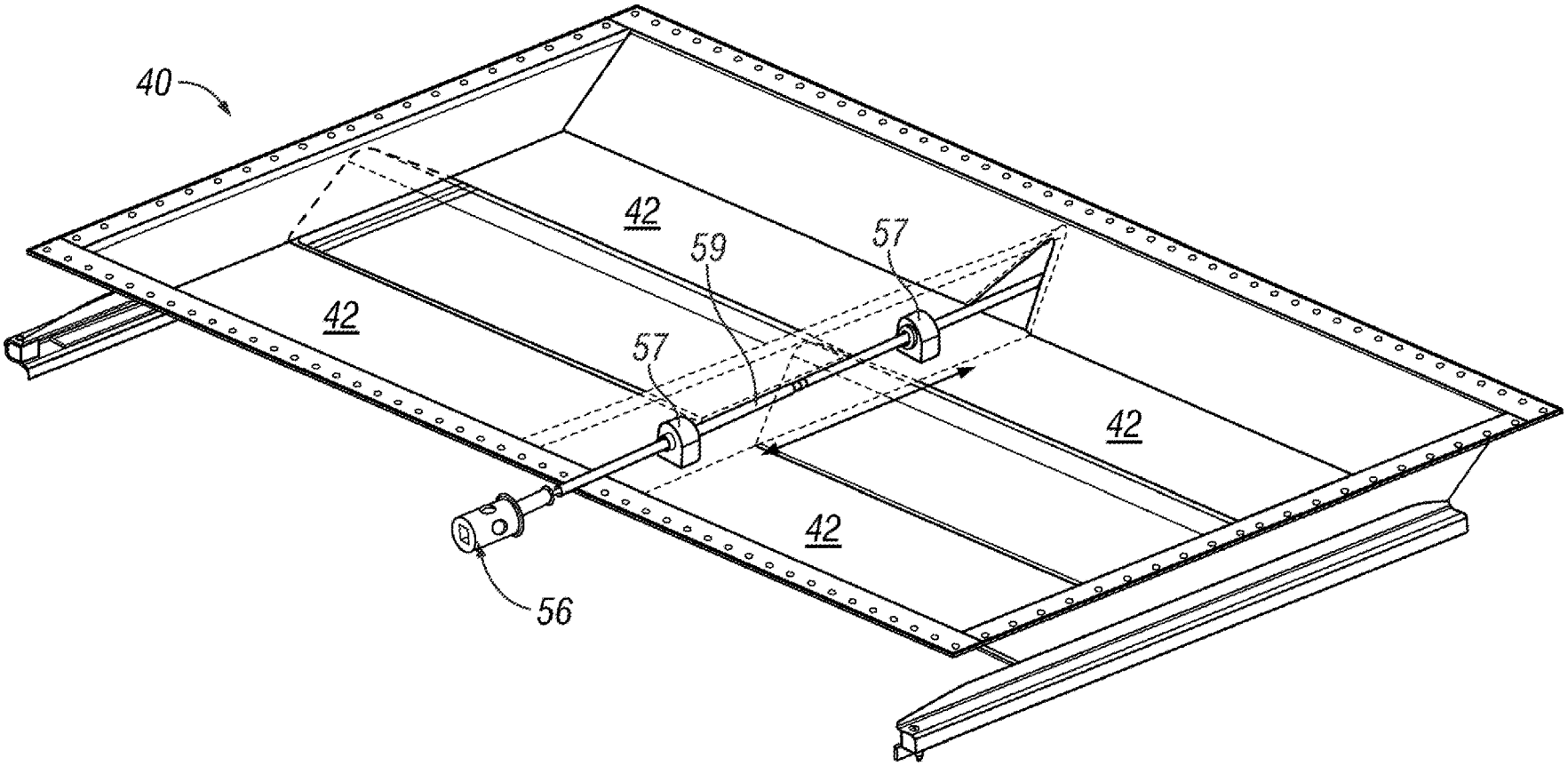
FIG. 5 is a perspective schematic illustrating a top view of the direction of gate travel for an example longitudinal sliding gate assembly.

FIG. 5 is a perspective schematic illustrating a top view of the direction of gate travel for an example longitudinal sliding gate assembly. Cross member 52*b* is illustrated as transparent to show the operation of threaded drive mechanism 54. Threaded drive mechanism 54 comprises threaded screw 59, one or more threaded nuts 57, and one or more capstans 56. One or more threaded nuts 57 are coupled to sliding gate 42. Threaded screw 59 passes through threaded nuts 57. A rotational motion of threaded screw 59 within threaded nuts 57 transfers a linear motion to sliding gate 42.

In operation, as capstan 56 is rotated, sliding gate 42 moves transversely across the rail car (as illustrated by the arrows in FIG. 5). Rotation in a first direction cause sliding gate 42 to move to an open position, and rotation in the opposite direction causes sliding gate 42 to move to a closed position.

Figure 6:
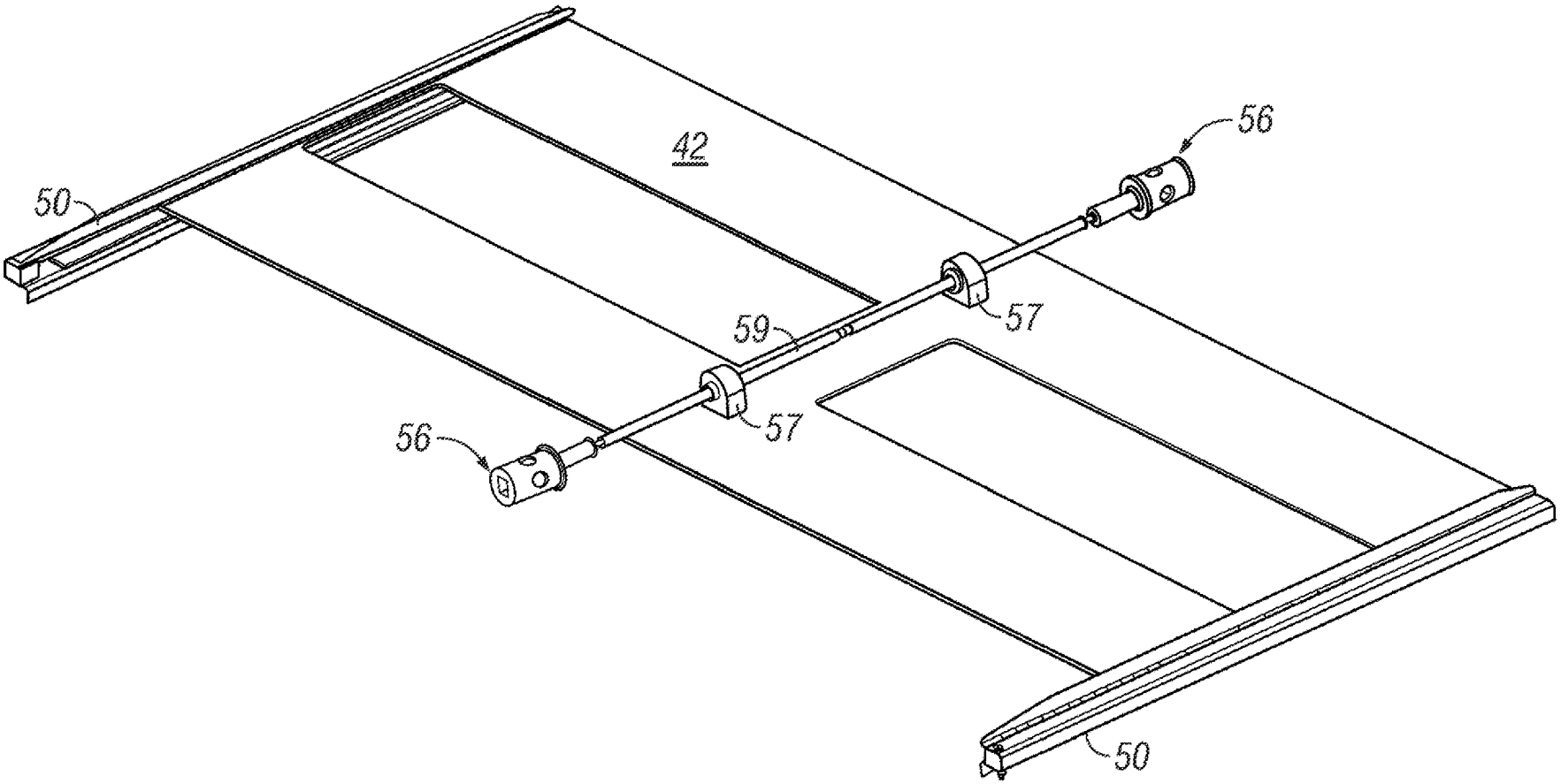
FIG. 6 is a perspective schematic illustrating a top view of the sliding gate, tracks, and threaded drive mechanism.

FIG. 6 is a perspective schematic illustrating a top view of the sliding gate, tracks, and threaded drive mechanism. In the illustrated example, the side and end walls and cross members are removed to illustrate the components of threaded drive mechanism 54 described with respect to FIG. 5. Sliding gate 42 is slidably coupled to tracks 50. In particular embodiments, tracks 50 may include rollers, bearings, or any suitable low friction material to facilitate movement of sliding gate 42.

Although two threaded nuts 57 are illustrated, other embodiments may include any suitable number and placement of threaded nuts. Other examples are illustrated with respect to FIGS. 10-13.

Figure 7:
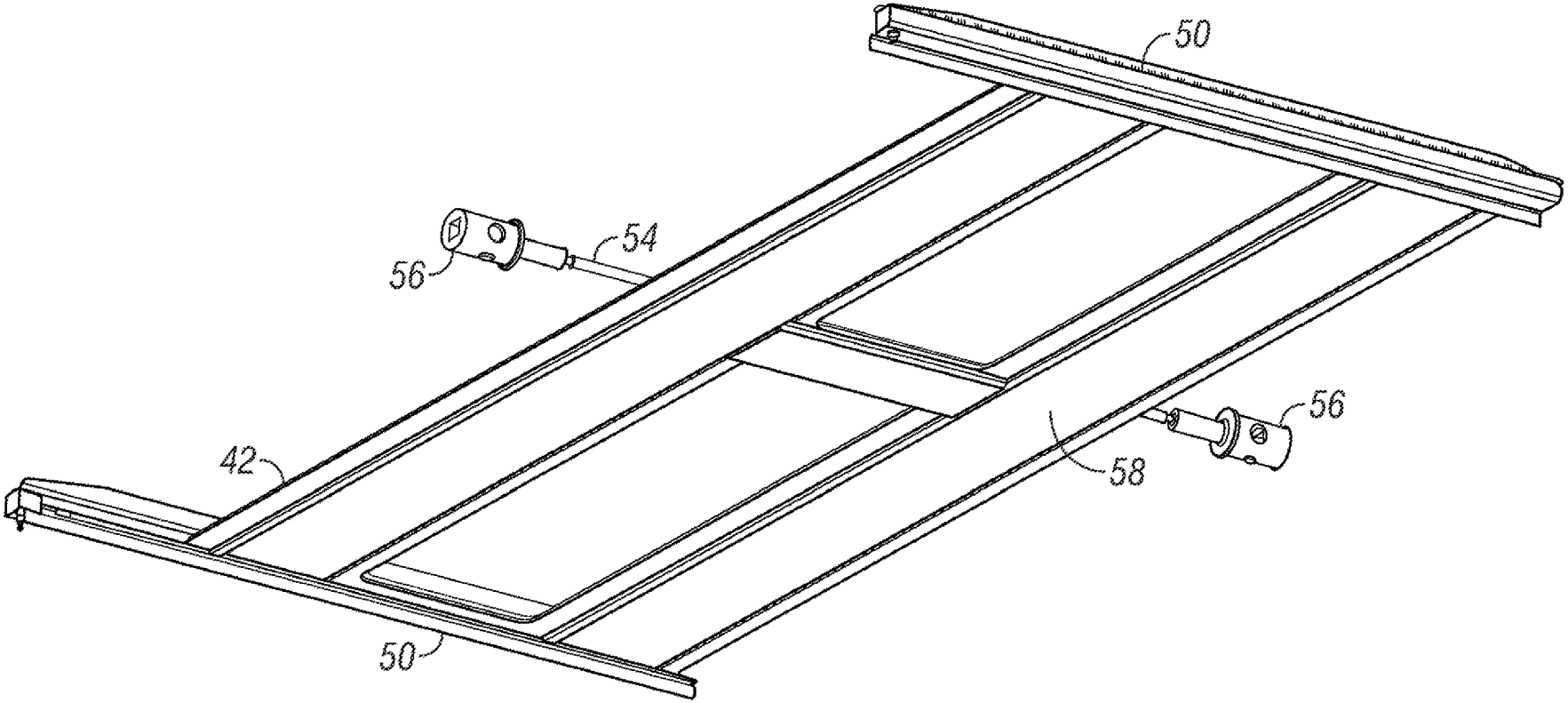
FIG. 7 is a perspective schematic illustrating a bottom view of the sliding gate, tracks, and threaded drive mechanism.

FIG. 7 is a perspective schematic illustrating a bottom view of the sliding gate, tracks, and threaded drive mechanism. The illustrated example includes slide gate reinforcements 58.

Slide gate reinforcements 58 strengthen sliding gate 42 to prevent or reduce deflection of sliding gate 42. Deflection of sliding gate 42 may cause binding (or reduced operational efficiency) of sliding gate 42 in track 50. For example, as the length of sliding gate 42 increases, the weight of sliding gate 42 itself may cause deflection of sliding gate 42.

The lading of the hopper car also provides a downward force on sliding gate 42, which may also contribute to deflection of sliding gate 42. Reinforcements at particular locations may prevent or reduce deflection of sliding gate 42. Additional examples of reinforcements are illustrated in FIGS. 14-21.

Figure 8:
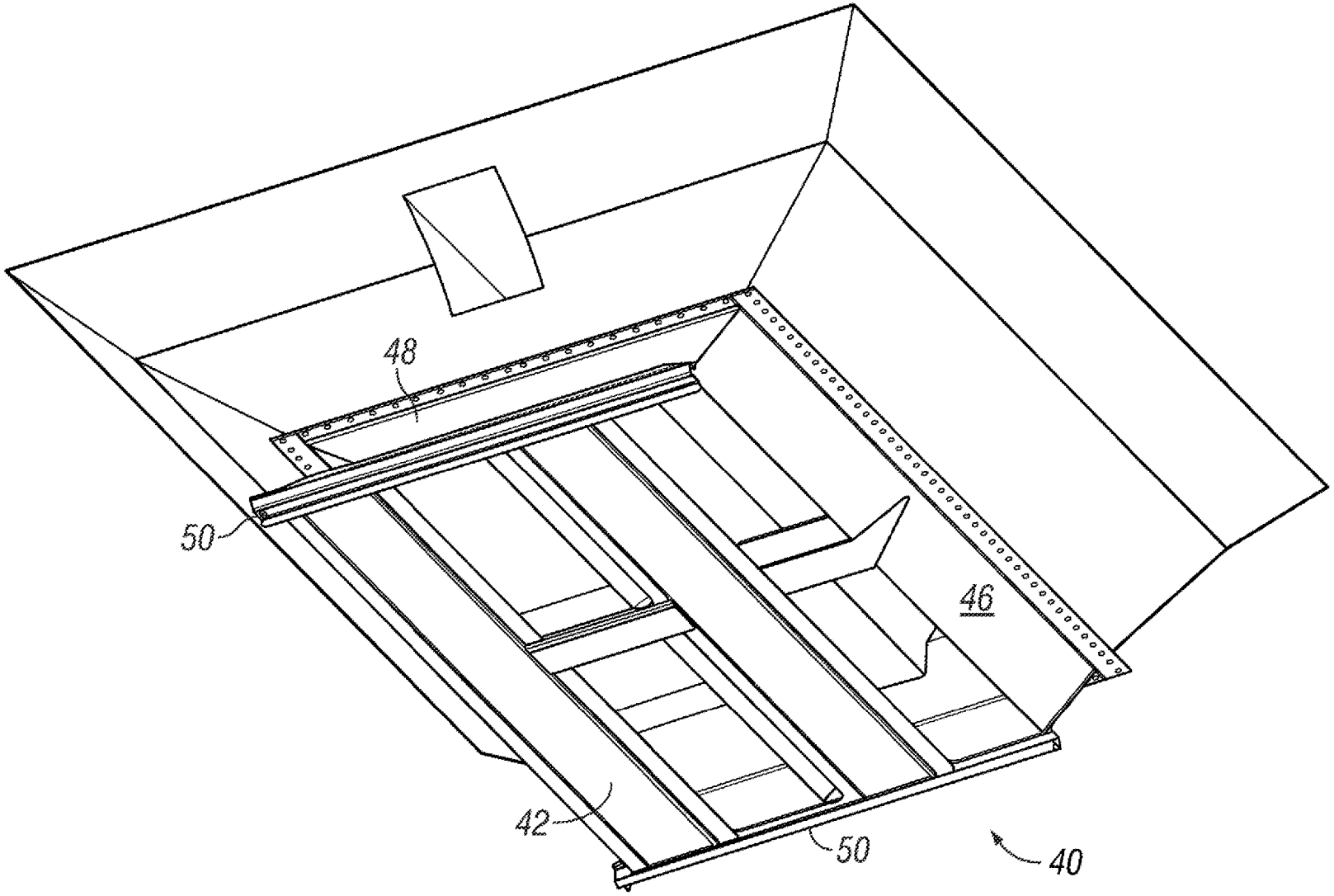
FIG. 8 is a perspective schematic illustrating an example of a longitudinal sliding gate assembly coupled to a hopper car with the sliding gates in an open position for full discharge.

FIG. 8 is a perspective schematic illustrating an example of a longitudinal sliding gate assembly coupled to a hopper car with the sliding gates in an open position for full discharge. Sliding gate 42 is positioned such that lading may flow through the discharge openings formed between center cross member 52*a* and side walls 46.

Figure 9:
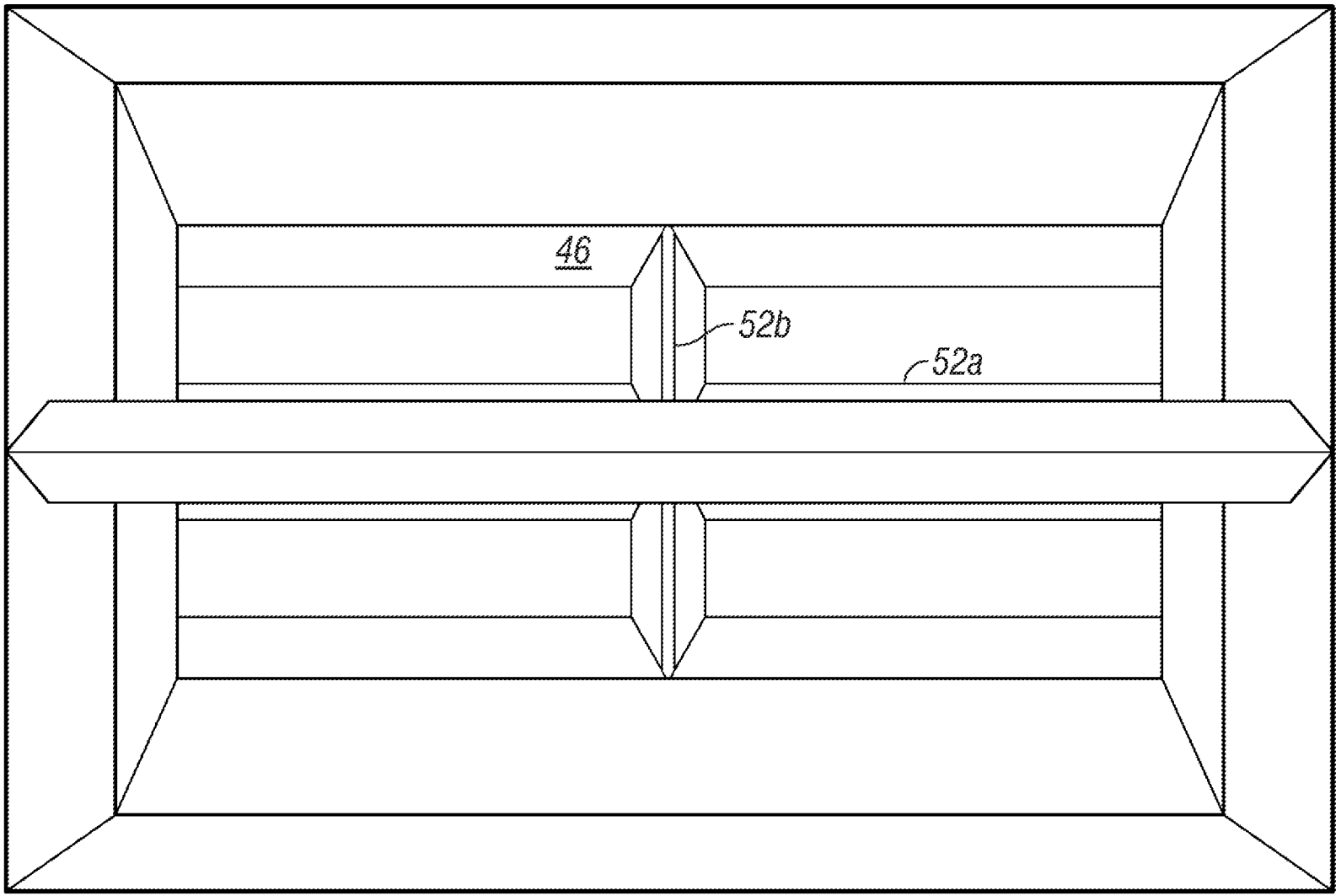
FIG. 9 is an overhead schematic illustrating an example of a longitudinal sliding gate assembly coupled to a hopper car with the sliding gates in an open position for full discharge.

FIG. 9 is an overhead schematic illustrating an example of a longitudinal sliding gate assembly coupled to a hopper car with the sliding gates in an open position for full discharge. The longitudinal sliding gate assembly of FIG. 9 is similar to FIG. 8, but from a different view point. The overhead view illustrates that in the open position, portions of sliding gate 42 may be underneath cross members 52.

Figure 10:
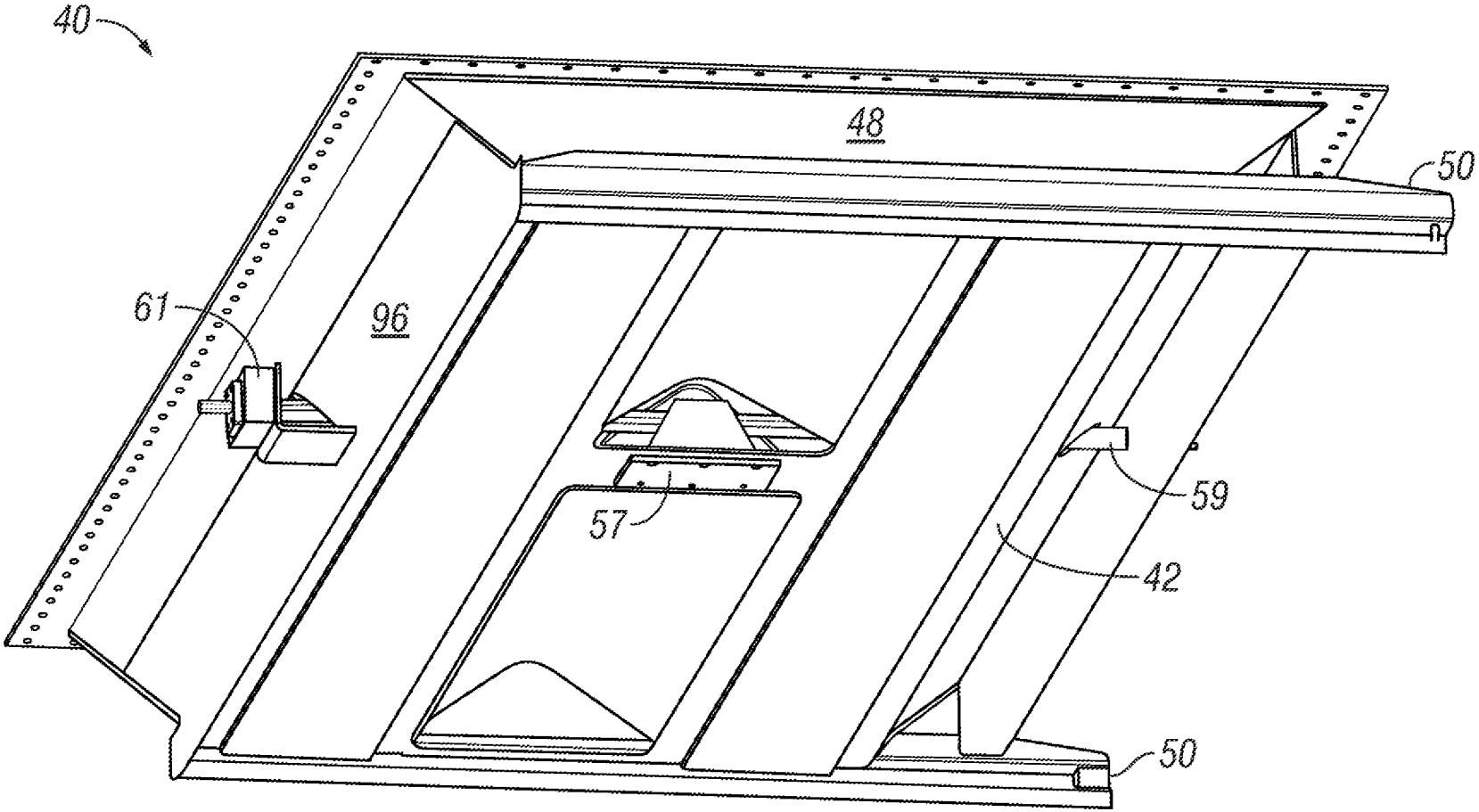
FIG. 10 is a perspective schematic illustrating another bottom view of an example longitudinal sliding gate assembly.

FIG. 10 is a perspective schematic illustrating another bottom view of an example longitudinal sliding gate assembly. The illustrated example includes additional examples of coupling the threaded drive mechanism to the sliding gate. In the illustrated example, a single threaded nut 57 couples threaded screw 59 to sliding gate 42. The threaded nut is illustrated in more detail in FIG. 13.

Threaded drive mechanism 54 is coupled to side wall 46 by support 61. may comprise any suitable coupling, housing, bearing, etc. that facilitates rotation of threaded screw 59 but prevents lateral or longitudinal movement of threaded screw 59.

Figure 11:
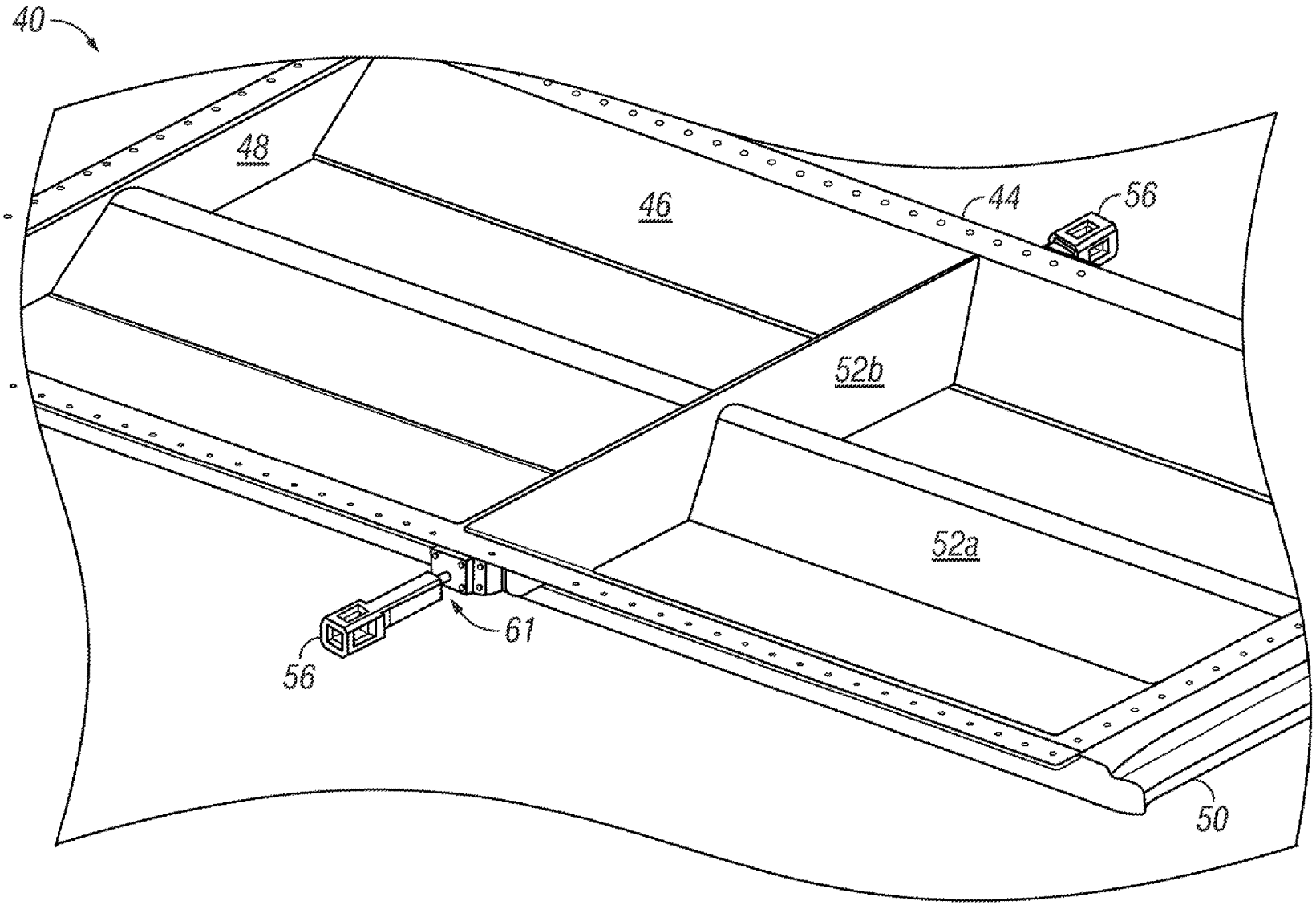
FIG. 11 is a perspective schematic illustrating another top view of an example longitudinal sliding gate assembly.

FIG. 11 is a perspective schematic illustrating another top view of an example longitudinal sliding gate assembly. The longitudinal sliding gate assembly of FIG. 11 is similar to FIG. 10 except viewed from the top.

Figure 12:
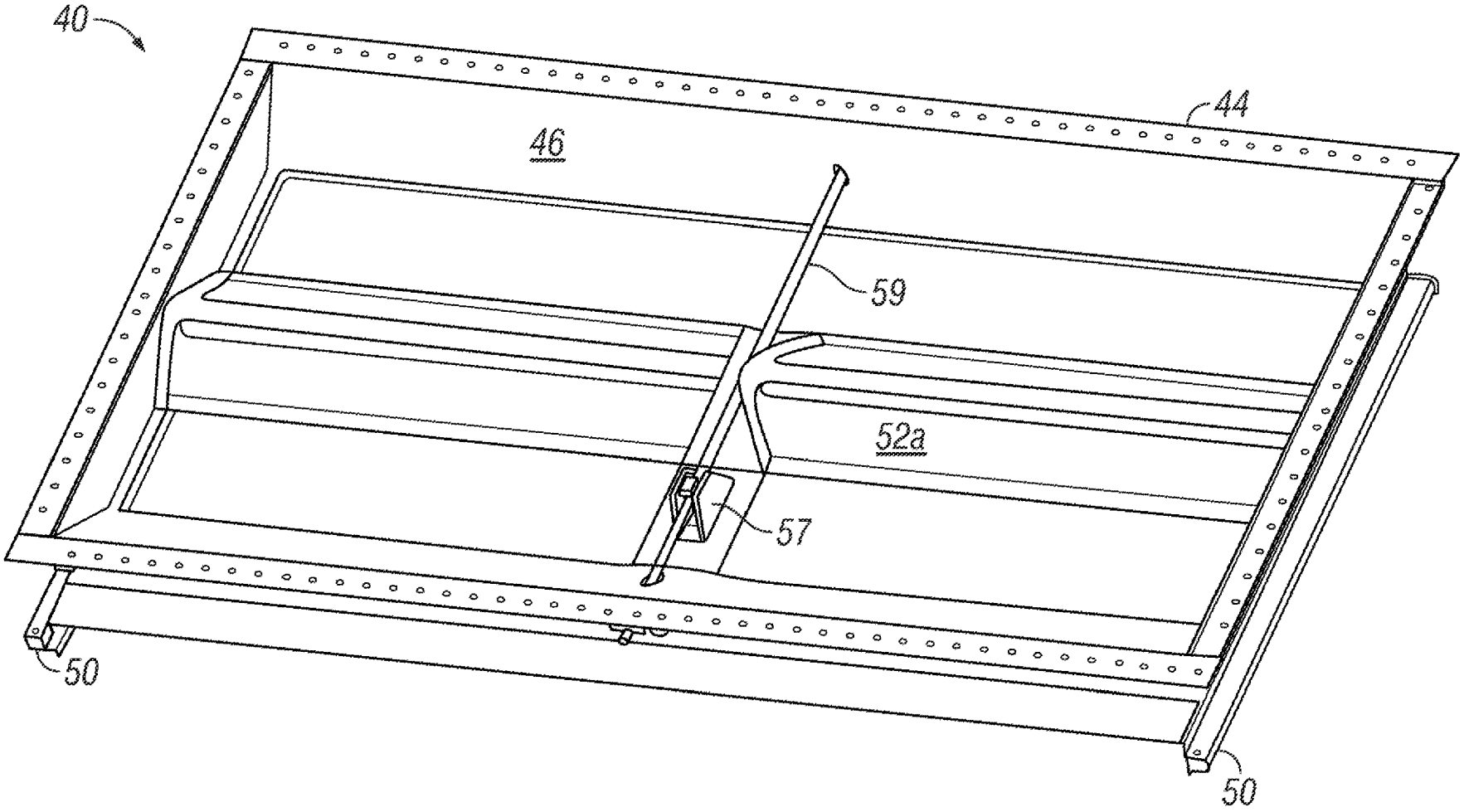
FIG. 12 is a perspective schematic illustrating another top view of an example longitudinal sliding gate assembly with a cross member removed.

FIG. 12 is a perspective schematic illustrating another top view of an example longitudinal sliding gate assembly with a cross member removed. The longitudinal sliding gate assembly of FIG. 12 is similar to FIG. 11 except cross member 52*b* is removed to show the path of threaded nut 57 and sliding gate 42 during rotation of threaded drive mechanism 54.

Figure 13:
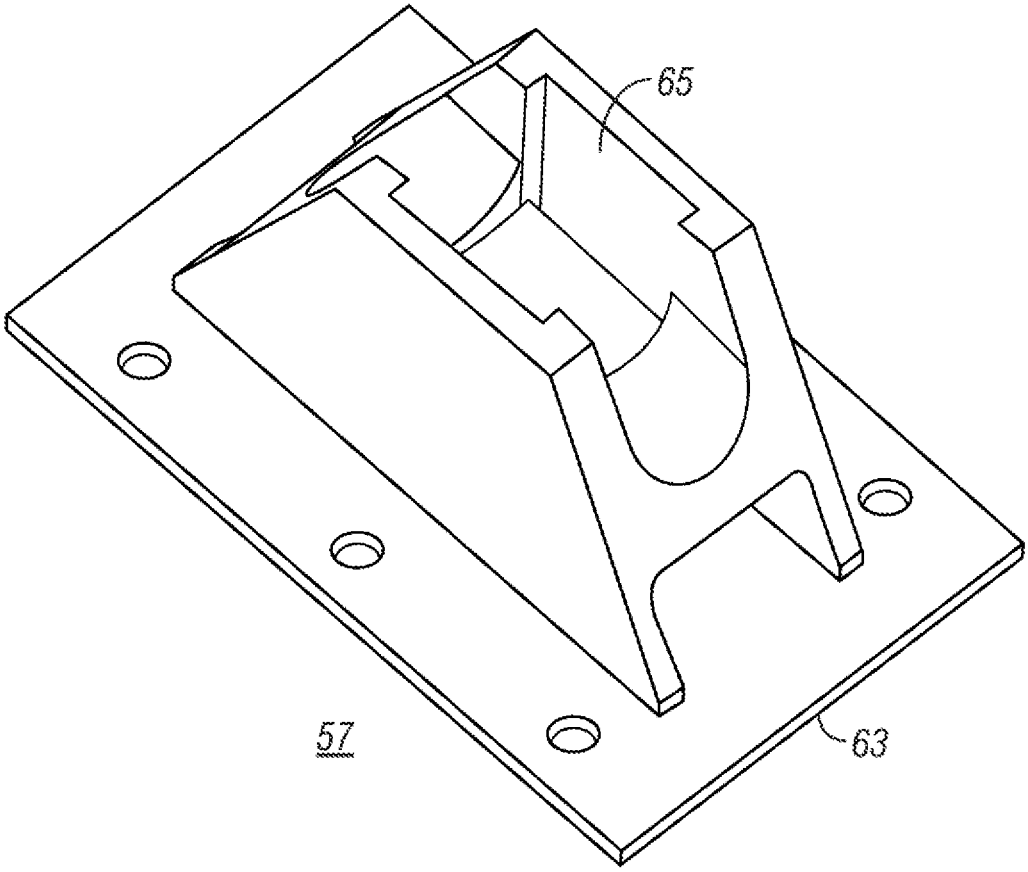
FIG. 13 is a perspective schematic drawing of an example threaded nut.

FIG. 13 is a perspective schematic drawing of an example threaded nut. Threaded nut includes base plate 63 and threaded portion 65. Base plate 63 may be couple to sliding gate 42. Base plate 63 may be coupled to sliding gate 42 via mechanical fasteners such as screws or bolts, via welding, or any other suitable fastener.

Threaded portion 65 couples to threaded screw 59. Threaded portion 65 is configured such that rotation of threaded screw 59 in threaded portion 65 moves threaded nut 57 laterally along threaded screw 59.

Figure 14:
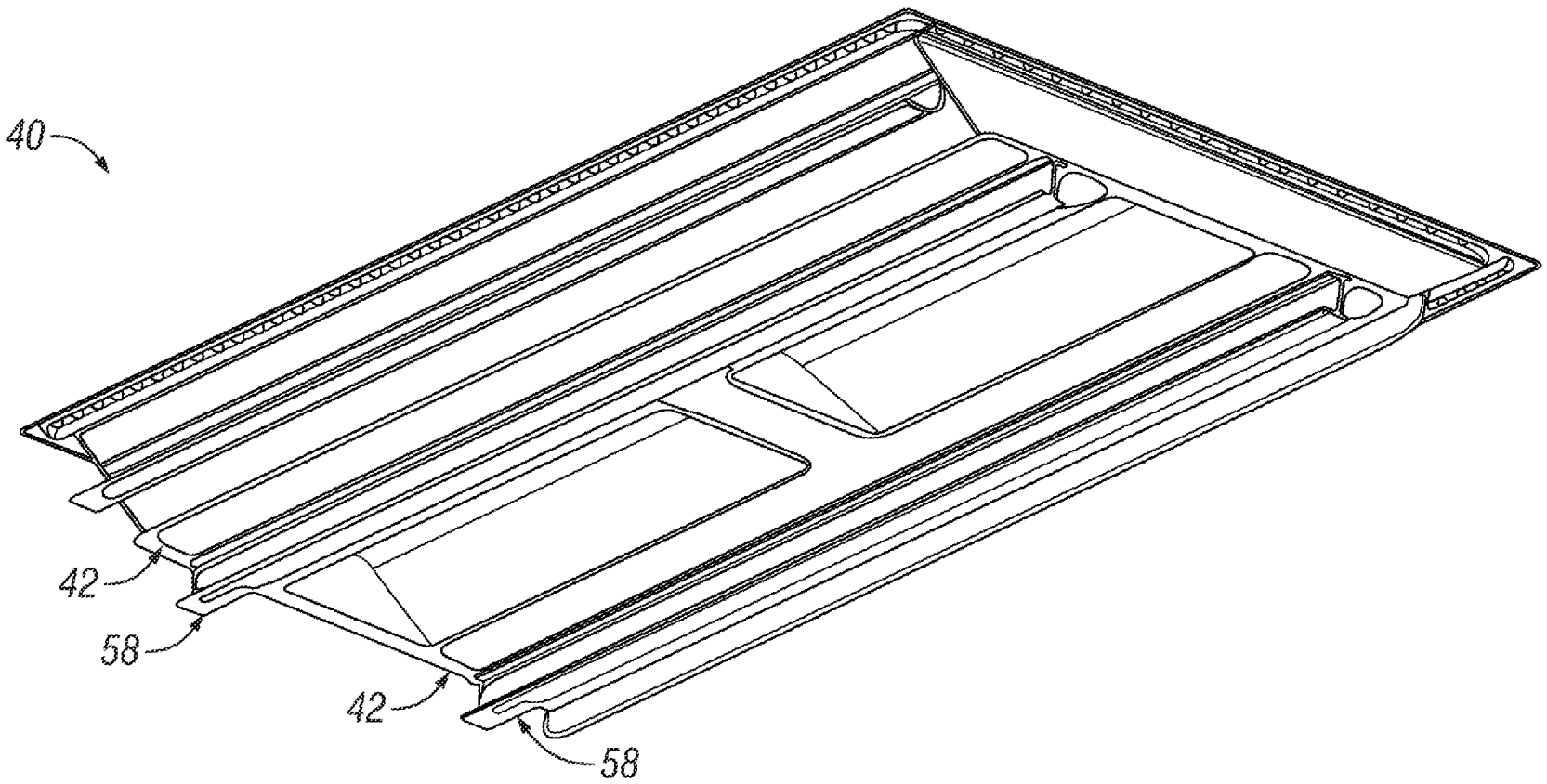
FIG. 14 is a perspective schematic from a side view of an example longitudinal sliding gate assembly with slide gate reinforcements.
Figure 15:
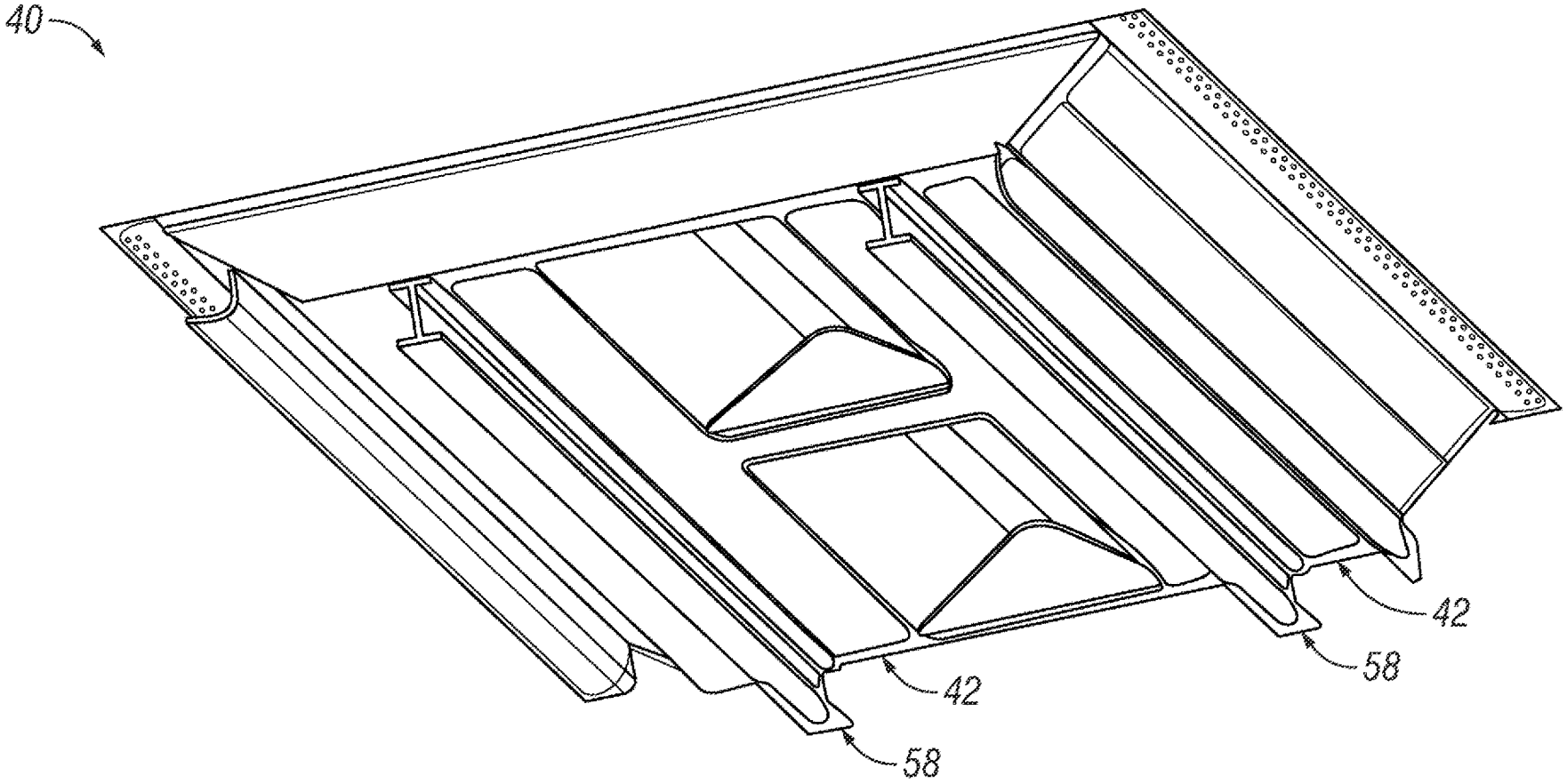
FIG. 15 is a perspective schematic from an end view of an example longitudinal sliding gate assembly with slide gate reinforcements.
Figure 16:
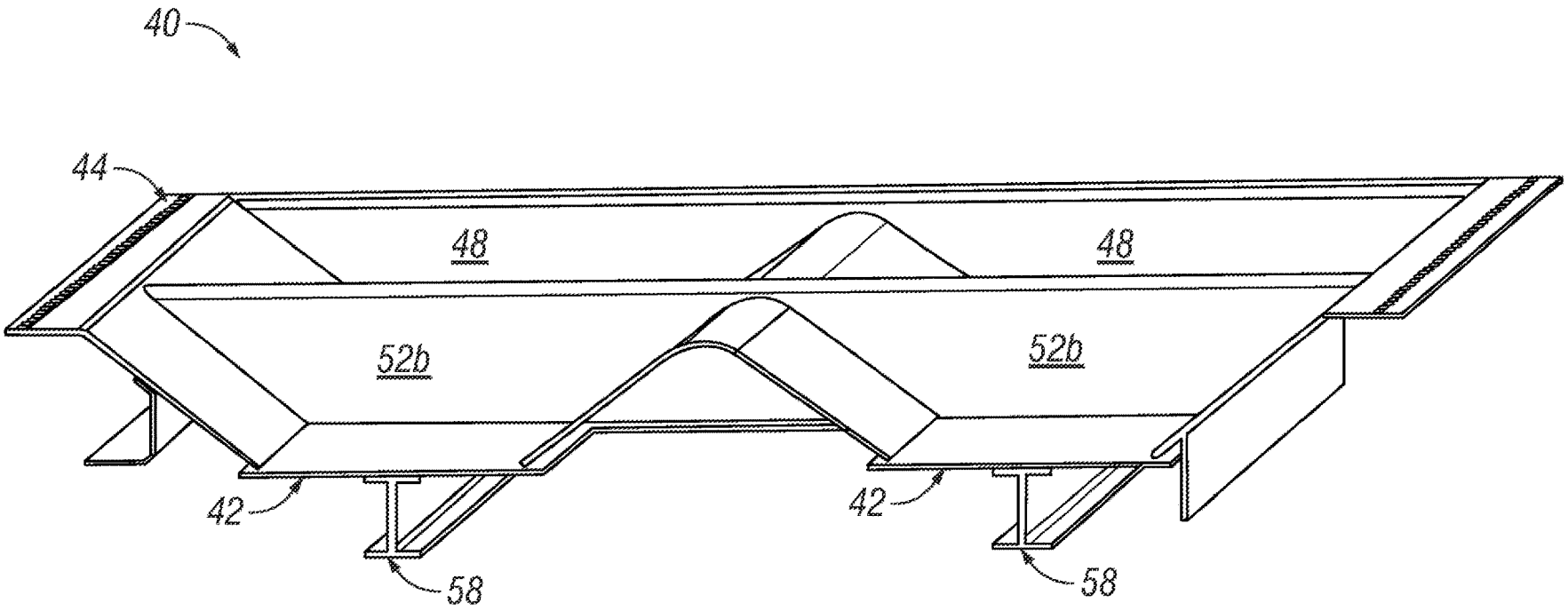
FIG. 16 is a perspective schematic cross-sectional view of an example longitudinal sliding gate assembly with slide gate reinforcements.

FIGS. 14-16 are perspective schematics illustrating example slide gate reinforcement, according to some embodiments. As described above with respect to FIG. 7, as the length of the sliding gate increases past four feet, for example, some embodiments may include slide gate reinforcements. Particular embodiments may include sliding gates often feet or longer.

FIG. 14 is a perspective schematic from a side view of an example longitudinal sliding gate assembly with slide gate reinforcements. In the illustrated example, slide gate reinforcement 58 is coupled to the bottom of sliding gate 42. Slide gate reinforcement 58 may include steel, aluminum, any suitable metal, metal alloy, or any suitable reinforcing material. Slide gate 58 may comprise an I-beam, H-channel, C-channel, or any other suitable configuration. Other configurations not illustrated may include more/less slide gate reinforcements in the longitudinal and/or transverse directions.

FIG. 15 is a perspective schematic from an end view of an example longitudinal sliding gate assembly with slide gate reinforcements. The longitudinal sliding gate assembly of FIG. 15 is similar to FIG. 14 except viewed from a different angle.

FIG. 16 is a perspective schematic cross-sectional view of an example longitudinal sliding gate assembly with slide gate reinforcements. The longitudinal sliding gate assembly of FIG. 16 is similar to FIGS. 14 and 15 except viewed as a longitudinal cross section.

Threaded drive mechanism 54 is not illustrated in FIGS. 14-16. In some embodiments threaded drive mechanism may be positioned below slide gate reinforcements 58. In some embodiments, slide gate reinforcements 58 may include cutouts, and threaded drive mechanism 54 may pass through the cutouts in slide gate reinforcements 58.

FIGS. 17-21 are perspective schematics illustrating another example of slide gate reinforcement, according to some embodiments.

Figure 17:
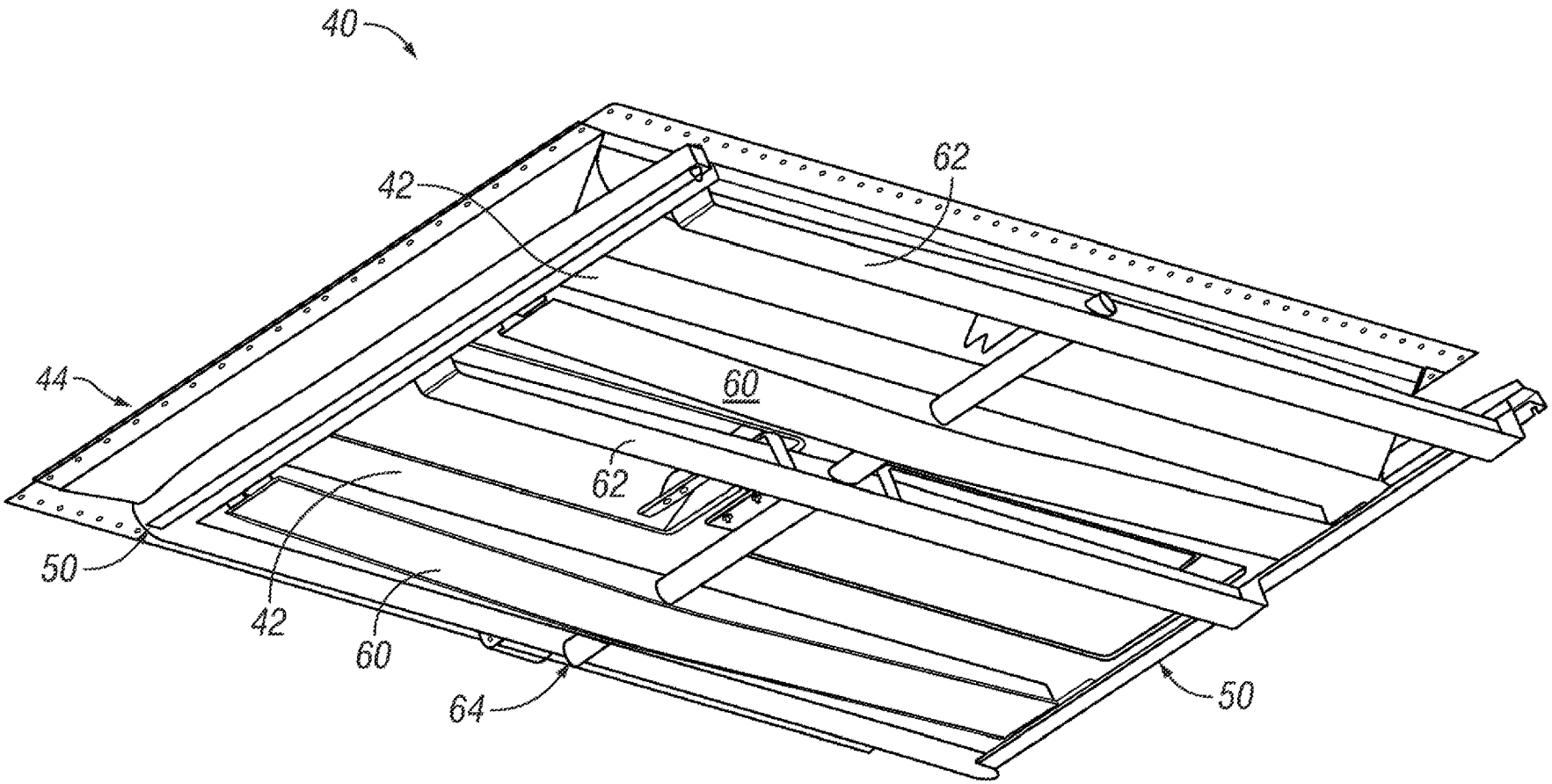
FIG. 17 is a perspective schematic illustrating a reinforced slide gate in the closed position, according to some embodiments.

FIG. 17 is a perspective schematic illustrating a reinforced slide gate in the closed position, according to some embodiments. The reinforcements include slide gate beams 60, support beams 62, and support bar 64. Particular embodiments include one support beam 62 near one end of tracks 50 and one support beam 62 near the centerline of the sliding gate apparatus. Support beams 62 provide support for support bar 64. Particular embodiments may include additional support beams 62 (e.g., near the other end tracks 50, etc.).

One or more slide gate beams 60 are coupled to sliding gate 42. Slide gate beam 60 is also slidably coupled to support bar 64. As sliding gate 42 moves back and forth, slide gate beams 60 move back and forth along support bar 64 (i.e., compare FIG. 17 with sliding gate closed and FIG. 18 with sliding gate open). In some embodiments, support bar 64 comprises a two and one-half inch diameter tube. Other embodiments may include different dimensions.

Figure 18:
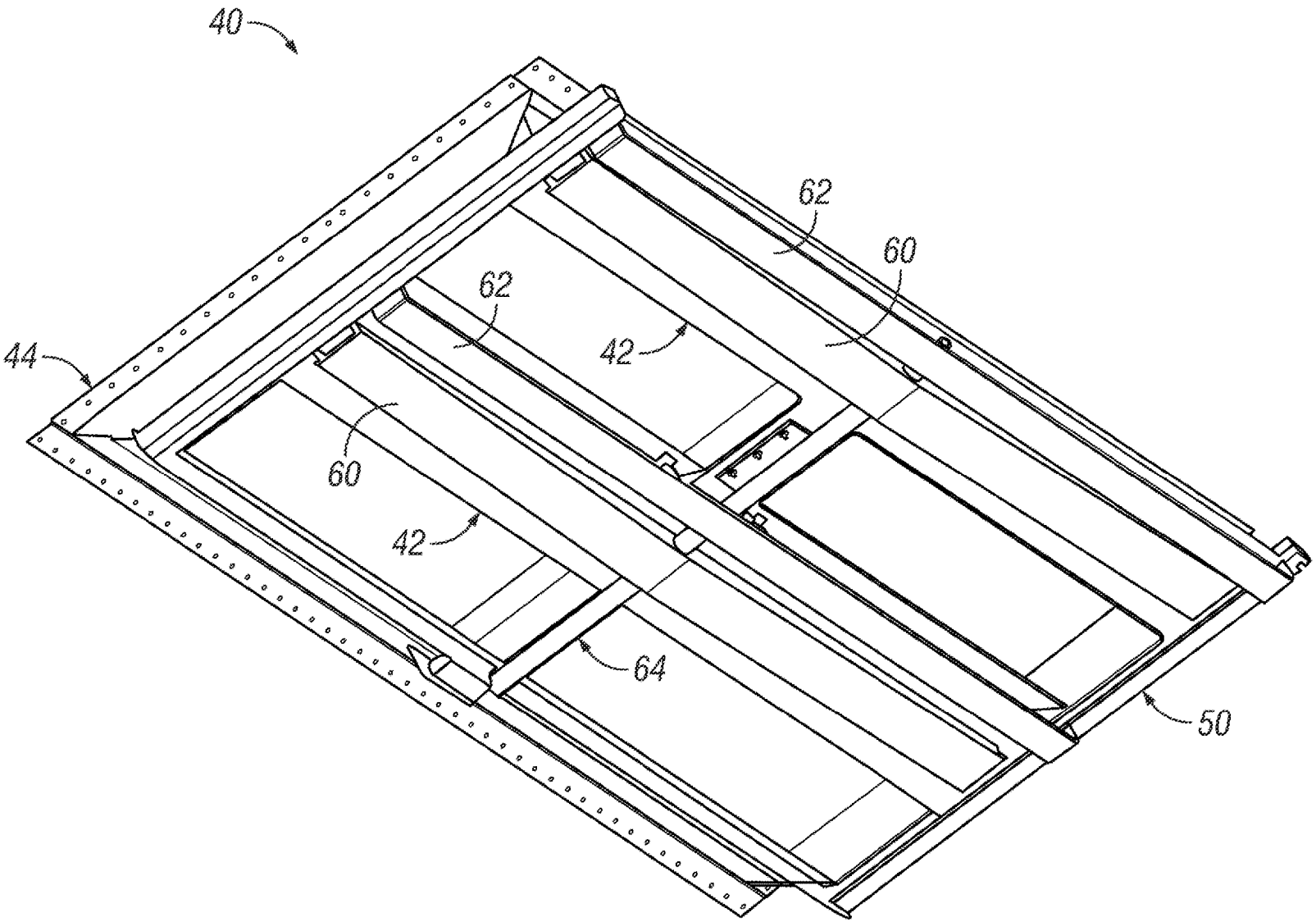
FIG. 18 is a perspective schematic illustrating a reinforced slide gate in the open position, according to some embodiments.

FIG. 18 is a perspective schematic illustrating a reinforced slide gate in the open position, according to some embodiments. Support beams 62 are positioned as not to interfere with slide gate beams 60 when sliding gate 42 is in the open position. In moving between the open and closed position, support beams 62 slide along support bar 64.

Figure 19:
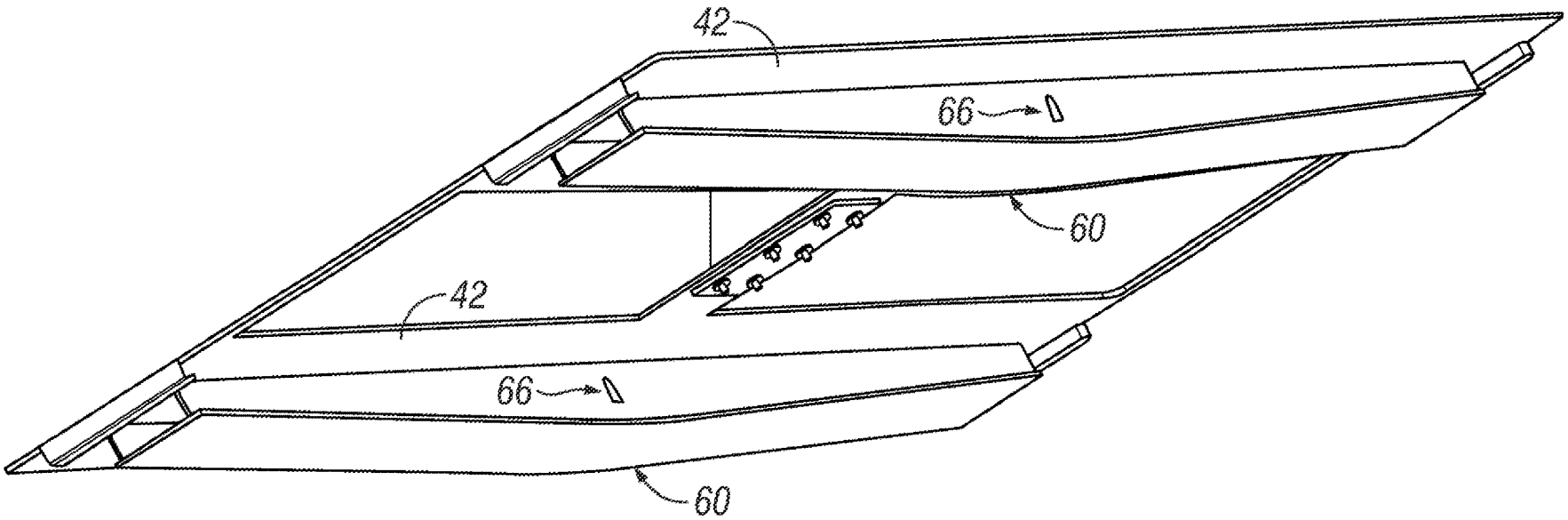
FIG. 19 is a perspective schematic illustrating a cutaway of a slide gate and slide gate beam, according to some embodiments.

FIG. 19 is a perspective schematic illustrating a cutaway of a slide gate and slide gate beam, according to some embodiments. In some embodiments, slide gate beam 60 includes openings 66. In operation, support bar 64 passes through openings 66.

Figure 20:
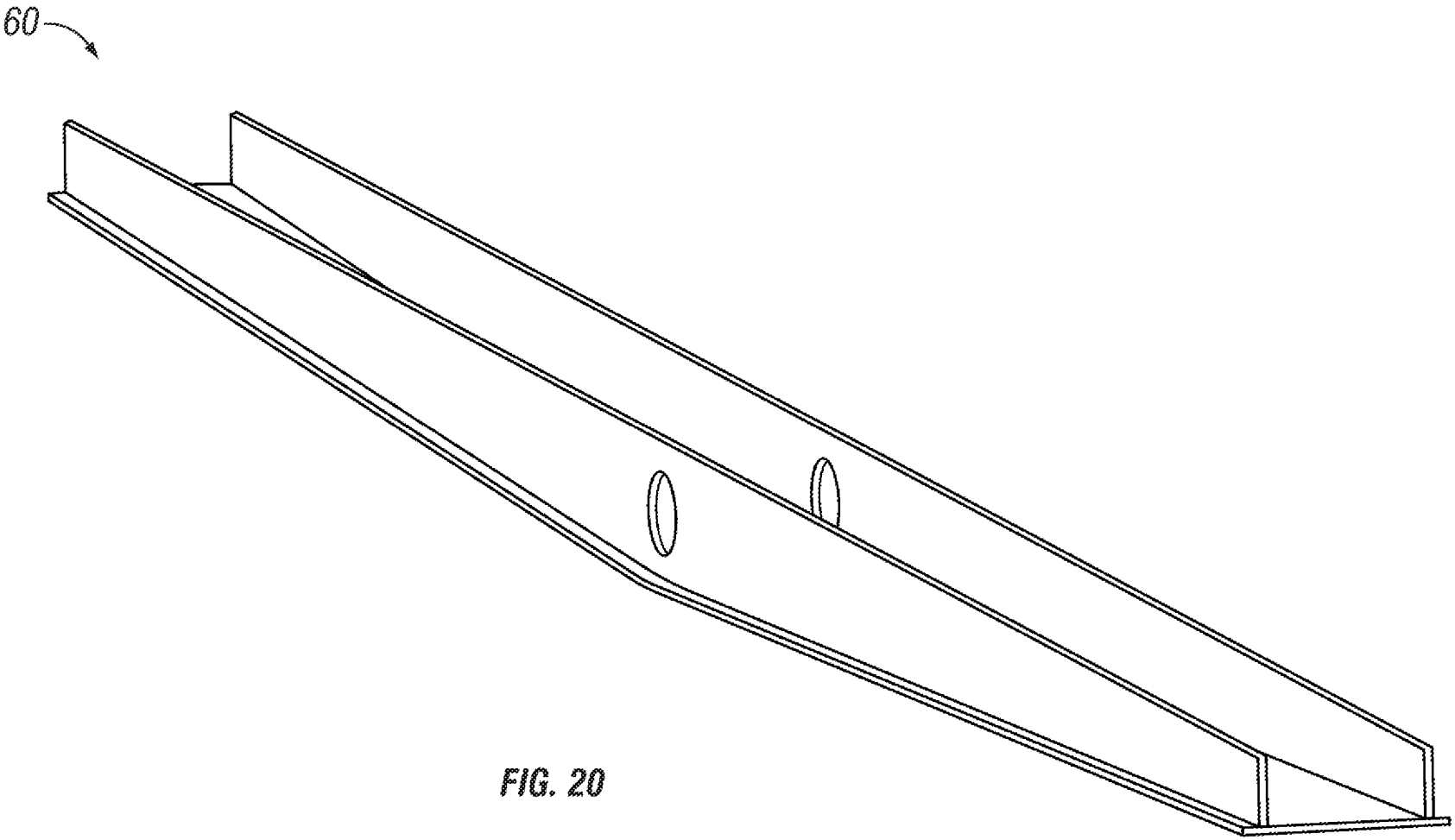
FIG. 20 is a perspective schematic illustrating an example slide gate beam.

FIG. 20 is a perspective schematic illustrating an example slide gate beam. The slide gate beam is an example of slide gate beam 60 illustrated in FIGS. 17-19. In some embodiments, slide gate beam 60 has a center depth of approximately four inches and a cover plate width of approximately six inches. The plates may be 3/18 of an inch in thickness. Other embodiments may include different dimensions.

Figure 21:
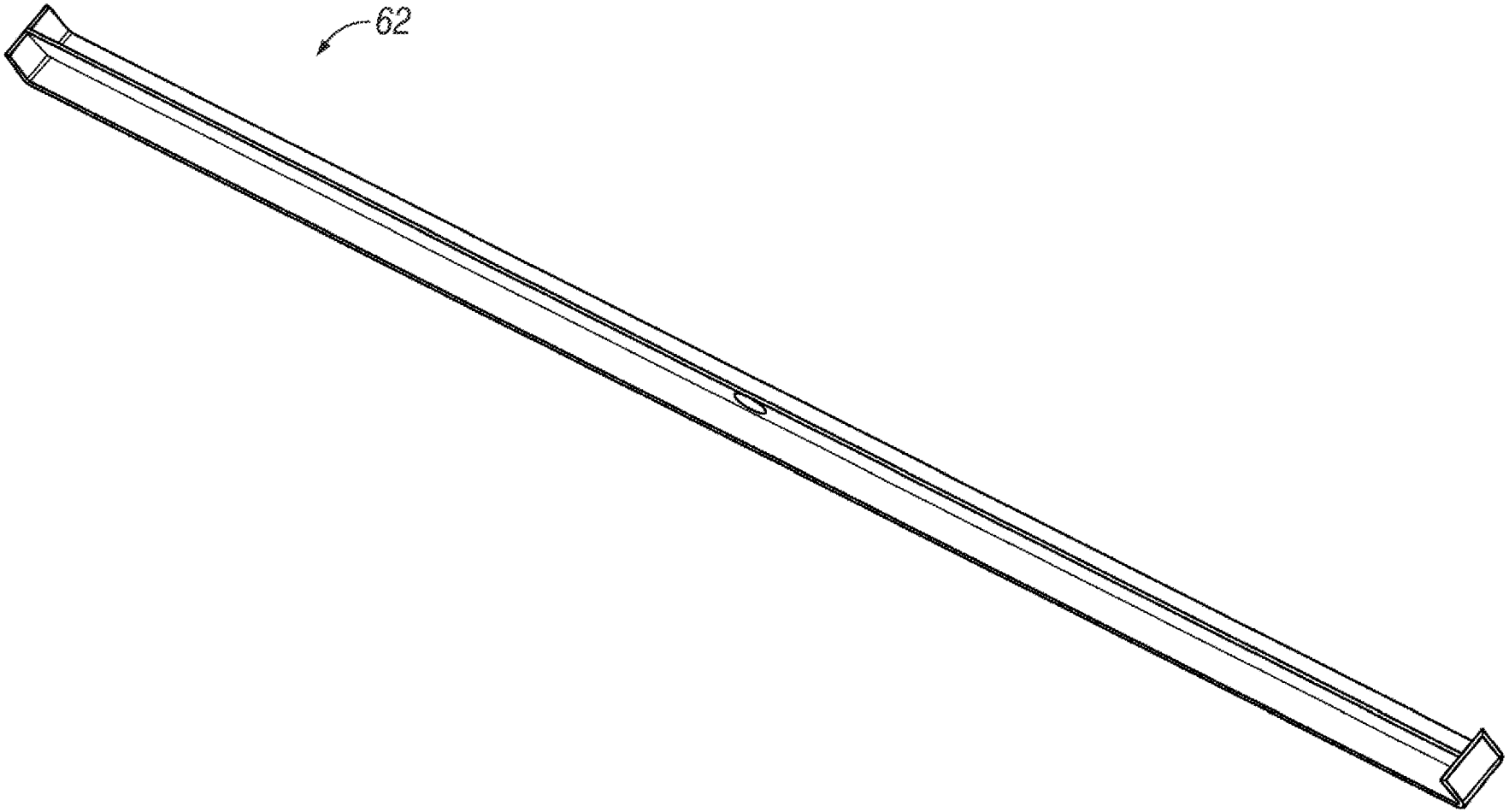
FIG. 21 is a perspective schematic illustrating an example support beam.

FIG. 21 is a perspective schematic illustrating an example support beam. The support beam is an example of support beam 62 illustrated in FIGS. 17-18. In some embodiments, support beam 62 has a center depth of approximately four inches and a cover plate width of approximately four inches. The plates may be 3/18 of an inch in thickness. Other embodiments may include different dimensions.

Although particular embodiments and their advantages have been described in detail, it should be understood that various changes, substitutions and alternations can be made herein without departing from the spirit and scope of the embodiments.

The invention claimed is:

1. A railcar comprising:

an underframe and at least one hopper coupled to the underframe, the hopper configured to transport a lading material;

a longitudinal sliding gate assembly coupled to the at least one hopper, the longitudinal sliding gate assembly comprising:

a pair of side walls coupled to a pair of end walls forming a discharge opening;

a pair of tracks, one coupled to each end wall;

a sliding gate slidably coupled to the pair of tracks;

a threaded drive screw coupled to the sliding gate and to the pair of side walls, wherein rotation of the threaded drive screw in a first direction moves the sliding gate along the tracks to an open position that permits the lading material to discharge through the discharge opening, and rotation of the threaded drive screw in an opposite direction to the first direction moves the sliding gate along the tracks to a closed position that restricts the lading material from discharging through the discharge opening;

a cross member coupled to the pair of end walls, the cross member forming a first discharge opening between the cross member and one side wall and forming a second discharge opening between the cross member and the other side wall; and wherein the sliding gate comprises a first longitudinal portion approximately the same size as the first discharge opening coupled to a second longitudinal portion approximately the same size as the second discharge opening, the first longitudinal portion separated from the second longitudinal portion by approximately the width of the cross member, the coupling causing the first longitudinal portion and the second longitudinal portion to move together in the same direction when moving in the first direction and when moving in the second direction.

2. The railcar of claim 1, wherein the sliding gate is oriented horizontally and operates in a transverse direction across the railcar.

3. The railcar of claim 1, further comprising a first capstan coupled to one end of the threaded drive screw, the first capstan configured to receive a tool for applying rotation to the threaded drive screw.

4. The railcar of claim 3, further comprising a second capstan coupled to the other end of the threaded drive screw, the first and second capstans permitting operation of the longitudinal sliding gate assembly from either side of the railcar.

5. The railcar of claim 1, the longitudinal sliding gate assembly further comprising a cross member coupled to the pair of side walls and positioned above the threaded drive screw to divert the lading material away from the threaded drive screw during discharge.

6. The railcar of claim 1, further comprising one or more longitudinal reinforcements coupled to the sliding gate.

7. The railcar of claim 1, wherein the cross member comprises an opening for the threaded drive screw to pass through.

8. The railcar of claim 1, further comprising one or more longitudinal reinforcements coupled to the pair of end walls.

9. The railcar of claim 8, wherein the one or more longitudinal reinforcements comprise an opening for the threaded drive screw to pass through.

10. A longitudinal sliding gate assembly comprising:

a pair of side walls coupled to a pair of end walls forming a discharge opening;

a pair of tracks, one coupled to each end wall;

a sliding gate slidably coupled to the pair of tracks;

a threaded drive screw coupled to the sliding gate and to the pair of side walls, wherein rotation of the threaded drive screw in a first direction moves the sliding gate along the tracks to an open position that permits a lading material to discharge through the discharge opening, and rotation of the threaded drive screw in an opposite direction to the first direction moves the sliding gate along the tracks to a closed position that restricts the lading material from discharging through the discharge opening;

a cross member coupled to the pair of end walls, the cross member forming a first discharge opening between the cross member and one side wall and forming a second discharge opening between the cross member and the other side wall; and wherein the sliding gate comprises a first longitudinal portion approximately the same size as the first discharge opening coupled to a second longitudinal portion approximately the same size as the second discharge opening, the first longitudinal portion separated from the second longitudinal portion by approximately the width of the cross member, the coupling causing the first longitudinal portion and the second longitudinal portion to move together in the same direction when moving in the first direction and when moving in the second direction.

11. The longitudinal sliding gate assembly of claim 10, further comprising a first capstan coupled to one end of the threaded drive screw, the first capstan configured to receive a tool for applying rotation to the threaded drive screw.

12. The longitudinal sliding gate assembly of claim 11, further comprising a second capstan coupled to the other end of the threaded drive screw, the first and second capstans permitting operation of the longitudinal sliding gate assembly from either side of the longitudinal sliding gate assembly.

13. The longitudinal sliding gate assembly of claim 10, further comprising a cross member coupled to the pair of side walls and positioned above the threaded drive screw to divert the lading material away from the threaded drive screw during discharge.

14. The longitudinal sliding gate assembly of claim 10, further comprising one or more longitudinal reinforcements coupled to the sliding gate.

15. The longitudinal sliding gate assembly of claim 10, wherein the cross member comprises an opening for the threaded screw drive to pass through.

16. The longitudinal sliding gate assembly of claim 10, further comprising one or more longitudinal reinforcements coupled to the pair of end walls.

* * * * *